US008613116B1

(12) United States Patent
Wood

(10) Patent No.: US 8,613,116 B1
(45) Date of Patent: Dec. 24, 2013

(54) POOL COVER HANDLING DEVICE AND METHODS OF USE

(76) Inventor: Robyn Wood, Lakewood, CO (US)

( * ) Notice: Subject to any disclaimer, the term of this patent is extended or adjusted under 35 U.S.C. 154(b) by 1010 days.

(21) Appl. No.: 12/357,747

(22) Filed: Jan. 22, 2009

(51) Int. Cl.
*E04H 4/00* (2006.01)

(52) U.S. Cl.
USPC ..... 4/502; 242/919

(58) Field of Classification Search
USPC ..... 4/502, 500, 498, 496, 488; 242/919, 242/388–388.2; 160/24
See application file for complete search history.

(56) References Cited

U.S. PATENT DOCUMENTS

| | | | | |
|---|---|---|---|---|
| 2,517,393 | A | 6/1947 | Law | |
| 2,472,075 | A * | 6/1949 | Hole | 244/155 A |
| 3,070,811 | A | 1/1963 | Bender | |
| 3,091,414 | A | 5/1963 | Patnaude | |
| 3,138,356 | A * | 6/1964 | McClain | 244/155 A |
| 3,982,286 | A | 9/1976 | Foster | |
| 4,324,370 | A | 4/1982 | Guard et al. | |
| 4,328,930 | A | 5/1982 | Kalendovsky | |
| 4,385,407 | A * | 5/1983 | Zook | 4/499 |
| 4,407,027 | A | 10/1983 | Colon, Jr. | |
| 4,459,711 | A | 7/1984 | Sartain et al. | |
| 4,467,978 | A | 8/1984 | Farrington | |
| 4,811,433 | A | 3/1989 | MacDonald et al. | |
| 4,939,798 | A | 7/1990 | Last | |
| 5,184,356 | A | 2/1993 | Lof et al. | |
| 5,282,282 | A | 2/1994 | Shehan et al. | |
| 5,425,143 | A | 6/1995 | Kalandovsky | |
| 5,524,302 | A | 6/1996 | Ragsdale et al. | |
| 5,701,613 | A | 12/1997 | Richardson | |
| 5,913,613 | A | 6/1999 | Ragsdale et al. | |
| 6,026,522 | A * | 2/2000 | Last | 4/502 |
| 6,618,869 | B1 | 9/2003 | Jacobs | |
| 6,622,318 | B2 | 9/2003 | Mathis | |
| 6,647,561 | B2 * | 11/2003 | Walton et al. | 4/502 |
| 6,871,362 | B1 | 3/2005 | Zell | |
| 6,931,673 | B1 | 8/2005 | Savage, Jr. | |
| 7,152,254 | B2 | 12/2006 | Smith | |
| 2005/0097834 | A1 | 5/2005 | King et al. | |
| 2005/0102744 | A1 | 5/2005 | Wood | |
| 2006/0123536 | A1 | 6/2006 | Smith | |

* cited by examiner

*Primary Examiner* — Gregory Huson
*Assistant Examiner* — Janie Christiansen
(74) *Attorney, Agent, or Firm* — Leyendecker and Lemire, LLC

(57) ABSTRACT

A device for facile deployment of a flexible pool cover, and methods of use, are described. Embodiments of the device and methods of use enable deployment of a pool cover with a leading edge of the pool cover being propelled substantially evenly across a liquid surface of a pool.

18 Claims, 5 Drawing Sheets

POOL COVER HANDLING DEVICE AND METHODS OF USE

FIELD OF THE INVENTION

The present invention relates generally to floating beams adapted to facilitate flexible covers across liquid surfaces in cavities, such as swimming pools.

BACKGROUND

Covers for swimming pools serve many functions. Those functions include inhibiting evaporation of water, inhibiting loss or concentration of solutes in the water, thermally insulating the water, facilitating solar gain, and protecting pools from contamination by debris and other contaminants. Flexible pool covers offer advantages that include relatively compact storage configuration. For instance, typical storage schemes include rolled storage means such as collecting a flexible pool cover onto a reel or roll at an end of the pool. Such rolled storage means enables facile removal of a flexible pool cover, and also provides a relatively compact arrangement for the pool cover when the cover is in a relatively compact storage configuration, wrapped around the reel.

Storing a flexible pool cover wrapped around a reel at an end or side of the pool presents a convenient position and orientation for subsequent deployment of the pool cover. Because pool covers are often deployed and removed every day, convenience and ease of storage and use are important considerations.

While flexible pool covers are adapted to facile removal and compact storage at a convenient location, deployment of flexible pool covers is more problematic. Deploying flexible pool covers on or above a surface of water in the pool can be relatively difficult and inefficient, particularly where deployment is conducted by a single user. For instance, one person typically deploys a flexible pool cover by grasping a leading edge of the cover at or near a corner, and drawing the cover partially across the pool by walking from one side or end of the pool to an opposite side or end. The cover is typically drawn only partially across the pool because the flexible nature of the pool cover allows an opposite corner at the leading edge of the cover to lag substantially behind the grasped corner. The opposite corner typically lags substantially behind as it is dragged across or slightly below the surface of the water, with pool cover material bunched, folded, or otherwise crumpled behind the lagging corner. Frequently, water flows or accumulates on top of the cover because the lagging corner, or a pool cover edge proximate the lagging corner, is slightly submerged.

The person deploying the flexible pool cover typically facilitates complete deployment of the cover by repeatedly repositioning the cover as the person works his or her way along an edge of the pool, and frequently back and forth at an edge of the pool, to straighten the bunched or folded pool cover. The person therefore eventually gets the flexible pool cover completely deployed, but the lagging corner phenomenon creates problems. One problem is that added time and effort are required to get the cover completely deployed. In addition, water tends to accumulate on top of the cover where it is ill-positioned because it can interfere with pool cover functions, including the pool cover functions enumerated above.

Problems described here are more pronounced with larger flexible pool covers and larger pools. For instance, dragging an 18 feet wide flexible pool cover across a water surface in an 18 ft by 36 foot or larger pool provides greater opportunity for a corner to lag substantially, for the flexible pool cover to become bunched or folded, and for water to flow onto the pool cover, than with a smaller pool. Conversely, a relatively narrow pool, such as a pool adapted to only a single person swimming laps that is 8 feet or less wide, is relatively easy to cover with a flexible pool cover without encountering the aforementioned problems. Thus a swimming pool with a surface area of less than 112 square feet (7 ft×16 ft) is typically less problematic to cover with a flexible pool cover.

Solutions to problems associated with deployment of flexible pool covers have been either relatively complex and expensive, or ineffective. For example, automated flexible swimming pool cover assemblies, as well as some manual assemblies, utilize tracks permanently installed above the surface of the water along opposite sides of the pool. During deployment, a leading edge of the pool cover is directly or indirectly coupled to the tracks and drawn along the tracks from one end of the pool to an opposite end. Such track-based assemblies involve relatively laborious installation and complex hardware that require substantial investment of resources. Moreover, swimming pool accessories such as ladders, which are permanently or semi-permanently installed at an edge of the pool, are complicated or difficult to accommodate with hardware and installation intensive automated pool cover deployment systems.

Substantial installation and removal expenses strongly discourage removing the track-based assemblies when a pool owner or user moves to a new home. Expense and permanence make installation of such track-based assemblies a capital property investment or expense. Simpler, less complex solutions to deployment covers typically offer little time-savings or are relatively ineffective at preventing water from becoming ill-positioned on top of a deployed flexible pool cover.

DETAILED DESCRIPTION

Figure 1:
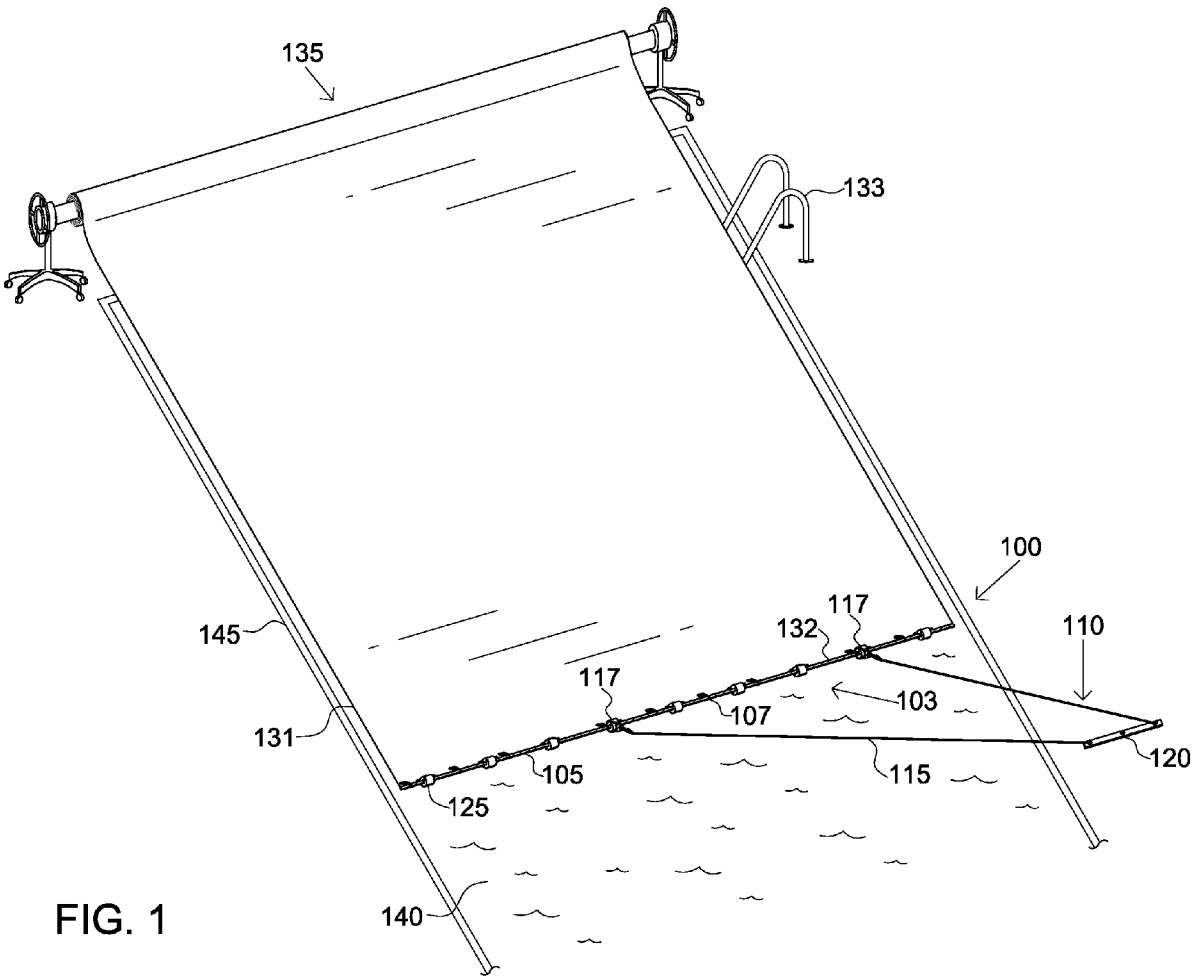
FIG. 1 is an isometric view of a pool cover handling device, according to one embodiment of the present invention.

Embodiments of the present invention comprise a relatively simple pool cover handling device that enables a person to draw a flexible pool cover across a surface of a body of liquid disposed in a pool cavity, while preventing, minimizing, or mitigating accumulation of liquid on top of the cover. Moreover, the pool cover handling device facilitates drawing a leading edge of the flexible pool cover across the surface of liquid in the pool without a portion of the leading edge becoming submerged, without a corner of the leading edge lagging substantially behind another corner of the leading edge, and without a portion of the cover becoming bunched, folded, or otherwise crumpled behind the lagging corner. Embodiments of the pool cover handling device are adapted to help keep an edge of a flexible pool cover on or slightly above the surface of liquid in the pool cavity when the flexible pool cover is drawn across the surface of the liquid. In addition, some embodiments of the pool cover handling device enable one person to move a flexible pool cover from a compact orientation into a completely deployed orientation without repeatedly repositioning the cover as the person moves back and forth, or works his or her way along an edge of the pool to straighten the bunched pool cover.

Embodiments of the pool cover handling device comprise a floating beam, the floating beam being adapted to float on a liquid to be covered, and comprising a substantially rigid elongate member. The floating beam is typically disposed at an edge of a flexible pool cover. In some embodiments, the floating beam is integral with or part of the pool cover edge, and in others it is coupled to but distinct from the pool cover edge. Embodiments of the floating beam are removably affixed to the pool cover edge such that the beam is readily attached to or removed from the pool cover edge. Variations of the floating beam are adapted to be readily transferrable from one pool cover to another.

The floating beam typically floats with a top surface of the elongate member residing above the surface of the liquid, the top surface thereby obstructing or impeding liquid from splashing or flowing onto the pool cover as the pool cover is deployed. Where the top surface of the elongate member resides about 2 mm higher than the liquid surface as the floating beam floats in the liquid, the top surface is marginally effective at obstructing or impeding liquid from splashing, flowing, or otherwise accumulating on the pool cover during deployment.

Embodiments of floating beams adapted to float with top surfaces of elongate members residing about 5 mm higher than the liquid surface as the floating beam floats in the liquid are substantially more effective at obstructing or impeding liquid from splashing, flowing, or otherwise accumulating on the pool cover during deployment. Embodiments of floating beams adapted to float with top surfaces of elongate members residing more than 20 mm higher than the liquid surface are typically also effective, but generally not much more so than those that reside 5 mm to 20 mm higher than the liquid surface. Accordingly, floating beams are adapted to float on a liquid surface with top surfaces of elongate members preferably about 2 mm or more higher than the liquid surface, more preferably between 2 mm and 20 mm higher than the liquid surface, and most preferably between 5 mm and 20 mm higher than the liquid surface.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning "either or both."

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct connection between the identified elements, components, or objects. Often the manner of the coupling will be related specifically to the manner in which the two coupled elements interact.

The term "approximately," as used in this specification and appended claims, refers to plus or minus 5% of the value given. For example, approximately 0.7700 gram per cc covers a range of 0.7315 gram per cc to 0.8085 gram per cc.

The term "about," as used in this specification and appended claims, refers to plus or minus 15% of the value given. For example, about 20 mm covers a range of 17 mm to 23 mm.

The term "water tight density," as used in this specification and appended claims, refers to weight per unit volume of an article or assembly, where volume is that volume which will displace water when the item is submerged in water. For example, consider a 300 mm long section of hollow PVC pipe with an inside diameter of 15 mm and a wall thickness of 2.8 mm, consisting of PVC with a density of 1.40 gram per cc. Where the section of pipe is open at its ends such that water is free to fill the pipe's inner bore, the open pipe when submerged displaces approximately 47 cc water. The open pipe weighs approximately 65.8 grams, has a water tight density of approximately 1.40 grams per cc (65.8 grams/47 cc), and is therefore not buoyant in water. Conversely, where the section of pipe is sealed such that water is prevented from filling the pipe's inner bore, the pipe displaces approximately 100 cc water when submerged. The tube weighs 65.8 grams, has a water tight density of approximately 0.66 gram per cc (65.8 grams/100 cc), and is therefore buoyant in water. Pure water has a density of 1.0 gram per cc, and for the purposes of this application, an item with a water tight density less than 1.0 gram per cc is buoyant in water and will therefore float in or on water. A person of ordinary skill in the art recognizes that the presence of solutes in water changes the density of the resulting solution, and most water in pools therefore has a density that varies from that of pure water. Where an assembly comprises the unsealed section of pipe fitted with a buoyant member that displaces 200 cc water but weighs only 10 grams, the water tight density of the resulting assembly is approximately 0.31 gram per cc (75.8 grams/247 cc); the assembly is therefore buoyant.

The term "flexible," as used in this specification and appended claims, refers to pliant or supple material that yields, folds, or bends with little resistance and without breaking. Flexible material typically yields, folds, or bends without deforming permanently.

The term "substantially rigid," as used in this specification and appended claims, refers to a property of an elongate member, the property being resisting deflection in a lateral direction, the lateral direction being substantially perpendicular to a longitudinal axis of the elongate member. Typically, the elongate member is a component of a floating beam. For example, a schedule 40 polyvinyl chloride (PVC) pipe with an inside diameter of approximately 15 mm and an average wall thickness of approximately 2.8 mm, comprising PVC with a flexural strength of about 93 MPa, is substantially rigid as the term is used here. Conversely, a pipe with the same inside diameter and wall thickness, comprising medium density polyethylene with a flexural strength of about 12 MPa, is not substantially rigid. Similarly, a leading edge of a typical flexible pool cover, absent a rib or other member for imparting stiffness to the pool cover, is not substantially rigid. Polypropylene rope is typically flexible as opposed to being substantially rigid, whereas expanded polystyrene typically is rigid or semi-rigid as opposed to being flexible. A substantially rigid elongate member, when attached to an edge of a flexible pool cover, imparts functional rigidity to the edge of the flexible pool cover.

The term "elongate member," as used in this specification and appended claims, refers to an article or assembly whose longest dimension is at least 3 times as large as a largest perpendicular dimension. For example, an 9 inch long section of round pipe with a 3 inch outside diameter is an elongate member. Conversely, a 7 inch long section of round pipe with a 3 inch outside diameter is not an elongate member. An elongate member may comprise multiple sections coupled together, even where an individual section is not an elongate member. For example, 2 sections of pipe, each 6 inches long and each with an outside diameter of 4 inches, comprise an elongate member where the 2 sections of pipe are coupled together end to end for a combined length of 12 inches.

The term "buoyant member," as used in this specification and appended claims, refers to an article or assembly comprising a solid composition of matter with a water tight density of 0.25 gram per cc or less.

The term "top surface," as used in this specification and appended claims, refers to an upper most surface of an elongate member or a buoyant member as the elongate or buoyant member floats on a surface of a liquid.

The terms "substantially straight line," and "substantially straight line configuration," as used in this specification and appended claims, refers to a flexible pool cover whose leading edge is relatively straight as the flexible pool cover is propelled across a liquid surface in a pool. When a pool cover handling device according to the present invention is used with the flexible pool cover, the leading edge of the flexible pool cover assumes a relatively straight line described by a floating beam. It is recognized that the relatively straight lines of the leading edge and floating beam are typically not perfectly straight, and that the leading edges of the flexible pool cover and the floating beam may curve slightly as they are propelled across the liquid surface. The curvature is slight and gradual however, and does not include sharp bends or kinks. Accordingly, the flexible pool cover typically remains relatively free of folds as it is propelled across the liquid surface with the leading edge in a substantially straight line. It is recognized that other factors, such as strong wind or heavy debris residing on the flexible pool cover, may cause folds or wrinkles in the flexible pool cover even where the leading edge is in a substantially straight line.

A First Embodiment Pool Cover Handling Device

Figure 2:
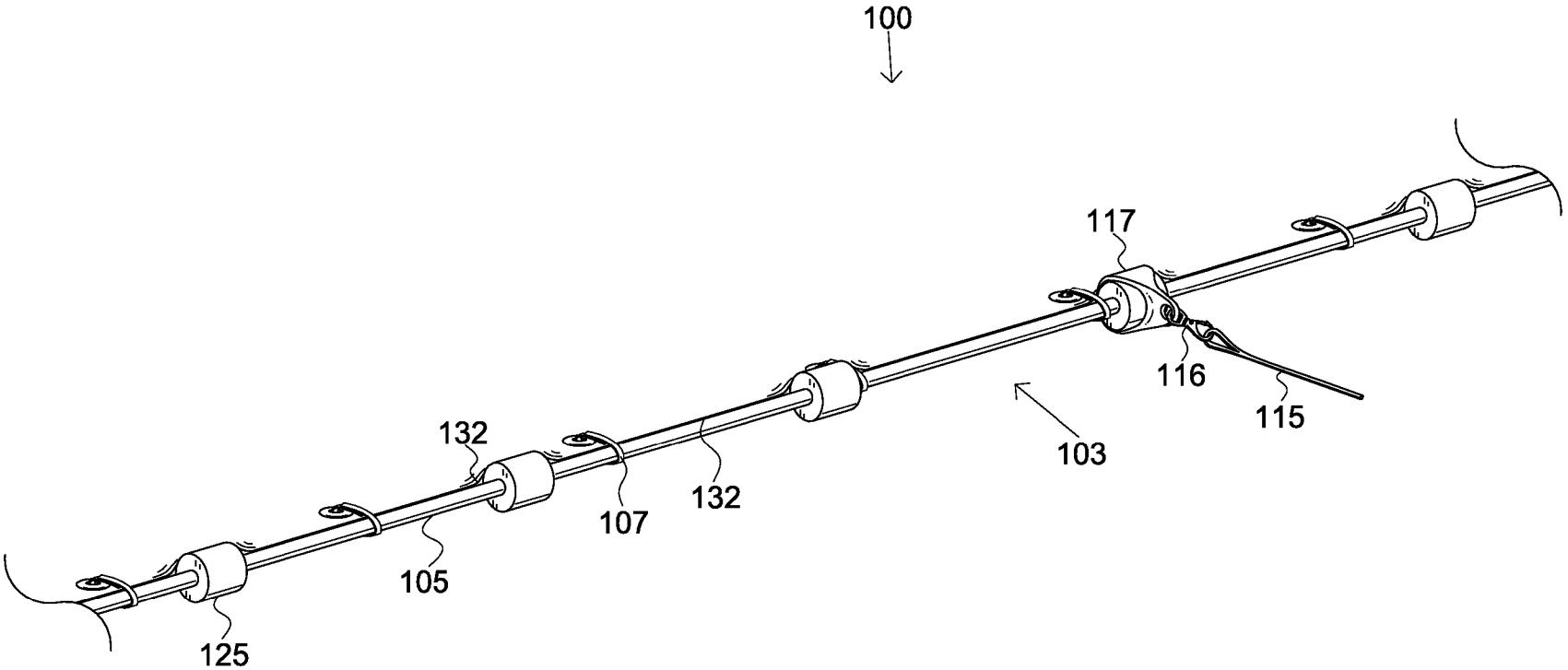
FIG. 2 is an isometric view of a pool cover handling device, according to one embodiment of the present invention.

A first embodiment pool cover handling device 100 is illustrated in FIGS. 1 and 2. The first embodiment pool cover handling device comprises an elongate member 105, an attachment assembly 107, a flexible pulling device 115, a coiling member 120, and multiple buoyant members 125. The attachment assembly comprises multiple loops that secure the pool cover handling device to a leading edge 132 of the flexible pool cover 131. Each of the multiple loops are adjustable so that the flexible pool cover can be pulled tightly against the elongate member, or arranged in a more relaxed configuration with the flexible pool cover not pulled tightly against the elongate member.

Each of the multiple loops goes through a grommet reinforced aperture in the flexible pool cover and each is also reversibly detachable so that the pool cover handling device can be detached from the flexible pool cover. The pool cover handling device may be reattached to the same flexible pool cover or to a different pool cover. Some embodiments of attachment assemblies do not require apertures in a pool cover in order to secure a pool cover handling device to a flexible pool cover, and variations of attachment assemblies comprise clips that grip, clasp, or clamp onto a flexible pool cover.

The flexible pool cover 131 illustrated in FIG. 1 has been partially deployed from a rolled storage device 135 familiar to persons of ordinary skill in the art, a deployed portion of the flexible pool cover residing on a water surface 140 of a swimming pool. A swimming pool edge 145 is visible in FIG. 1.

The swimming pool in FIG. 1 is 18 feet wide and 36 feet long, and the flexible pool cover 131 is about 16 feet wide, which results in a leading edge 132 that is about 16 feet in length. The elongate member 105 of the first embodiment pool cover handling device is also about 16 feet in length. Accordingly, the pool cover handling device does not extend completely across the pool, and is therefore adapted to deploy without being substantially obstructed by or getting hung up on a ladder 133 that protrudes into the swimming pool. The first embodiment pool cover handling device is illustrated in FIG. 1 in use with a built-in (in-ground) swimming pool. Some embodiments of the present invention are used, or are adapted for use with, above-ground pools.

Flexible pool covers are typically sized to completely or almost completely cover swimming pools. Thus, for a swimming pool that is 18 feet wide, an appropriate flexible pool cover is typically, but not necessarily, about 16-18 feet wide. Some embodiments of pool cover handling devices comprise elongate members that are shorter than leading edges of flexible pool covers to which the elongate members attach or are adapted to attach. For example, a flexible pool cover that is 18 feet wide is an appropriate size for the 18 ft×36 ft pool in FIG. 1. The first embodiment pool cover handling device, with an elongate member that is 16 feet long, is appropriate for use with an 18 feet wide flexible pool cover.

Embodiments of elongate members are typically, but not necessarily, about as long as a leading edge to which the elongate members are attached. An elongate members is preferably more than 50% as long as the leading edge, more preferably more than 75% as long as the leading edge, and most preferably about as long as the leading edge to which the elongate member is attached.

The flexible pool cover 131 of the first embodiment is adapted to cover about 90% of the water surface of the pool. Accordingly, a one sided area of the flexible pool cover is about 90% of an area of the water surface in the pool. The one sided area of the flexible pool cover is an area of either a top surface or a bottom surface of the flexible pool cover. Embodiments of pool covers typically cover, or are adapted to cover, most of an area of a water surface in a pool.

Together, the elongate member 105 and the multiple buoyant members 125 comprise a floating beam 103. The buoyant members of the first embodiment comprise expanded polyethylene foam with a density of about 0.035 gram per cubic centimeter, which impart sufficient buoyancy to the floating beam that a top surface of the elongate member resides more than 2 mm higher the water surface 140. Embodiments of buoyant members include, but are not limited to, buoyant members comprising open or closed cell foams, expanded polystyrene, polyolefin foams, polyurethane foams, or hollow "floats" comprising water tight cavities. Such hollow floats are familiar to persons of ordinary skill in the art, and are typically used to impart buoyancy to ropes that separate lanes in swimming pools.

The elongate member 105 of the first embodiment pool cover handling device 100 comprises hollow rigid polyvinyl chloride (PVC) tubing with an inside diameter of about 15 mm and an outside diameter of about 21 mm. The elongate member of the first embodiment is sealed so that water is unable to enter the elongate member's hollow center. In some embodiments, an elongate member is not sealed or water tight.

Buoyant members are typically used to contribute buoyancy to a floating beam whose elongate member lacks sufficient buoyancy to float with the floating beam's top surface a few millimeters or more higher than the liquid on which the floating beam floats. Accordingly, a buoyant member typically has a density well below that of water, preferably less than 0.25 gram per cubic centimeter, more preferably between 0.25 and 0.020 gram per cubic centimeter, and most preferably between 0.10 and 0.030 gram per cubic centimeter.

The elongate member 105 comprises five separable sections that are reversibly coupled together to create the elongate member's length of 16 feet. The separable sections are joined at joints that are concealed beneath buoyant members, and are therefore not visible in FIGS. 1 and 2. The joints comprise sleeves within which ends of the separable sections reside and are held in place by friction. Separable sections and joints may be added to or subtracted from a pool cover handling device in order create a different size device, and separable sections may all be a same length or may have various lengths. Some embodiments include elongate members with separable sections that join through other joining means, such as, but not limited to, threaded joints or twist-lock joints. Some embodiments include elongate members comprising a single unit without separable sections. Some elongate members comprise a plurality of sections that are not readily separated.

The leading edge 132 of the pool cover 131 butts against the floating beam 103. Thus in FIGS. 1 and 2 the leading edge of the pool cover can not be distinguished from the floating beam, except proximate the buoyant members 125 in FIG. 2, where the pool cover deforms slightly as the leading edge butts against the buoyant members, and the leading edge of the pool cover can be discerned. Where a leading edge of a pool cover butts against or is in close proximity to a floating beam, or where a pool cover is integral to or continuous with a floating beam, embodiments of a pool cover handling device are more effective at mitigating encroachment of liquid onto the pool cover during deployment. Where a substantial gap exists between a floating beam and a pool cover to which the floating beam is coupled, embodiments of a pool cover handling device are less effective at mitigating encroachment of water onto the pool cover during deployment. A gap of around 20-25 mm or more between a floating beam and a leading edge of a flexible pool cover results in a combination that is relatively ineffective at mitigating encroachment of water onto the pool cover during deployment.

Some embodiments of floating beams comprise an elongate member, but not a buoyant member, in which case the elongate member has a water tight density of less than 1.0 gram per cc in order to float. Where embodiments of floating members comprise both an elongate member and a buoyant member, the combined water tight density of the elongate member and the floating member must be less than 1.0 gram per cc, in order for the floating beam to float.

The flexible pulling device 115 and the coiling member 120 of the first embodiment pool cover handling device together comprise a propelling apparatus 110, the propelling apparatus being coupled by a rotatable coupler 117 to the floating beam 103, and adapted to propel the floating beam across the surface of the body of water in the pool. The propelling apparatus is coupled to the rotating coupler by use of a snap swivel hook 116, the snap swivel hook making the propelling apparatus readily removed from and reattached to the floating beam. The rotating coupler is best illustrated in FIG. 2 and is relatively free to rotate, its axis of rotation being a longitudinal axis of the elongate member 105. Some embodiments of rotating couplers are relatively free to slide along a longitudinal axis of an elongate member. The flexible pulling device of the first embodiment comprises braided polypropylene rope. Variations of flexible pulling devices include strings, ropes, chains, or similar devices that are flexible and are thus adapted to being folded, wrapped, or coiled.

A user typically deploys the pool cover 131 by grasping the propelling apparatus 110 and pulling the pool cover across the water surface 140 from a first end of the swimming pool, where an un-deployed portion of the pool cover is stored on the rolled storage device 135, to a second end of the swimming pool, the second end being opposite the first end. Variations of the propelling apparatus include devices adapted to push the floating beam across the water surface.

During typical deployment, the first embodiment pool cover handling device 100 stabilizes the leading edge 132 of the pool cover 131 in a substantially straight line, preventing a corner of the leading edge from lagging substantially behind. So deployed, the pool cover remains substantially flat on the water surface 140, without becoming bunched or folded during deployment, and water is impeded from splashing or flowing onto the pool cover as well.

Because the leading edge 132 of the pool cover 131 is in a substantially straight line during deployment, a single user, working alone, can deploy the pool cover completely in a single operation, the single operation comprising walking a length of a side of the swimming pool while propelling the floating beam the length of the side of the swimming pool.

Coiling of the flexible pulling device 115 on the coiling member 120 is illustrated in FIGS. 3A-3D. The coiling member comprises a core 121 on which are disposed two lateral guides 122. The core of the first embodiment comprises a PVC elongate member about 300 mm long and with an outside diameter of about 21 mm. Embodiments of coiling members are preferably greater than 100 mm long and more preferably between 150 and 450 mm long. The flexible pulling device 115 runs through the lateral guides, a section that resides between the lateral guides comprising a medial loop 123. Each of the lateral guides of the first embodiment pool cover handling device comprises an end hole 126 and a side hole 127. A total coiling member length is 300 mm, and the side holes are 250 mm apart. Variations of lateral guides comprise a plurality of slots, loops, or similar structures that guide, contain or restrain a flexible pulling device, and enable the flexible pulling device to slide through the lateral guides, an intra-lateral guide distance (between two of the lateral guides) being at least 100 mm. The coiling member further comprises a central aperture 128 disposed on the core between the lateral guides, the central aperture being a medial loop securing device. Other embodiments of medial loop securing devices include, but are not limited to, elastic straps and straps equipped with hook and loop fastening means. Embodiments of medial loop securing devices are adapted to hold the medial loop in place until a user wants to unwrap the medial loop from around the core.

The medial loop 123 comprises a section of the flexible pulling device 115 that a user may store by wrapping or coiling the medial loop 123 onto the coiling member 120 between the two lateral guides 122. A length of the section of the flexible pulling device comprising the medial loop is variable, and is typically enlarged by a user pulling the medial loop such that more of the flexible pulling device slides through the lateral guides to become part of the medial loop.

The medial loop is reduced in size by pulling a length of the flexible pulling device through the lateral guides, away from the medial loop.

Figure 3A:
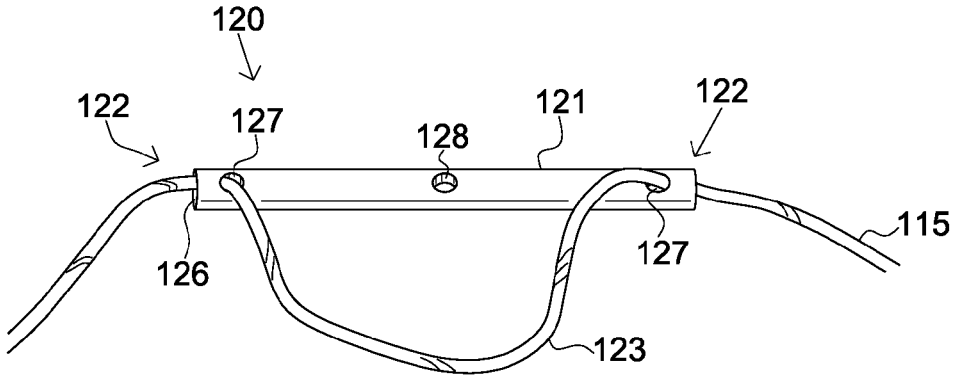
FIGS. 3A-3D are isometric views of a pool cover handling device, according to one embodiment of the present invention.
Figure 3B:
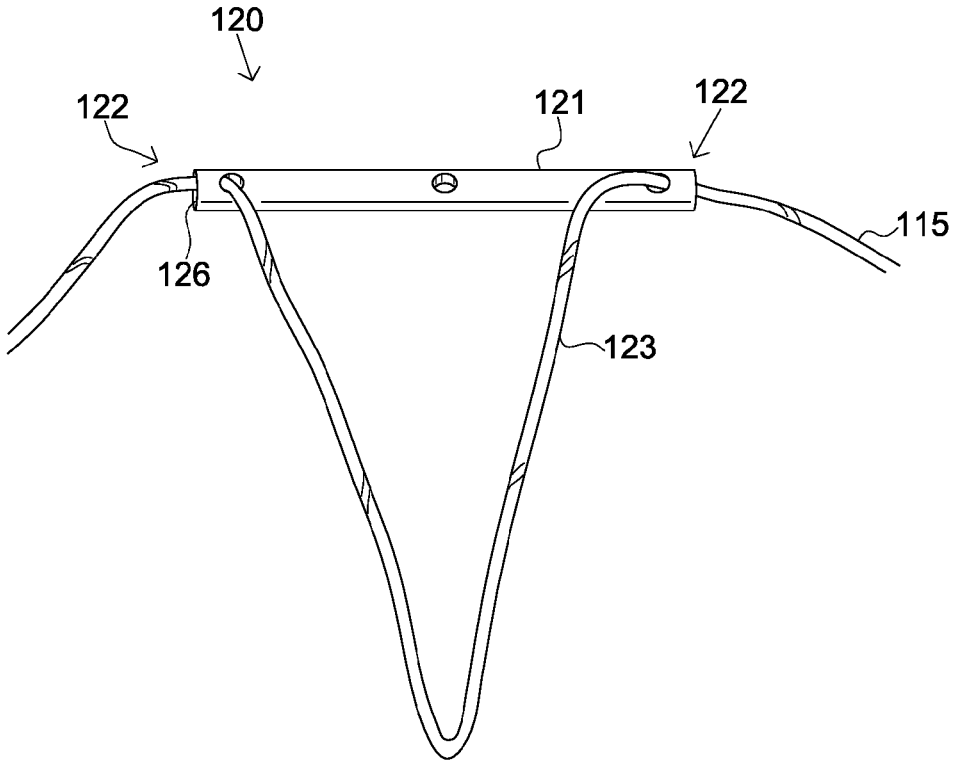
Figure 3C:
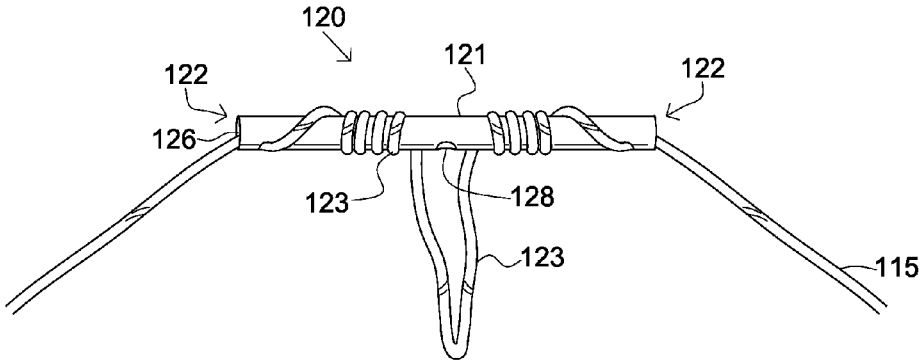

FIG. 3B illustrates a medial loop 123 that is enlarged compared to the medial loop in FIG. 3A because more flexible pulling device 115 has been pulled through the lateral guides 122 to join the medial loop. As illustrated in FIG. 3C, the medial loop is partially wrapped around the coiling member 120, and in FIG. 3D the medial loop is almost completely wrapped around the core 121 of the coiling member 120, with a medial loop tip 129 tucked into the central aperture 128 to secure the medial loop tip and prevent the flexible pulling device from unwrapping from around the core 121 The flexible pulling device is typically stored with the medial loop wrapped around the coiling member as illustrated in FIG. 3D.

Figure 3D:
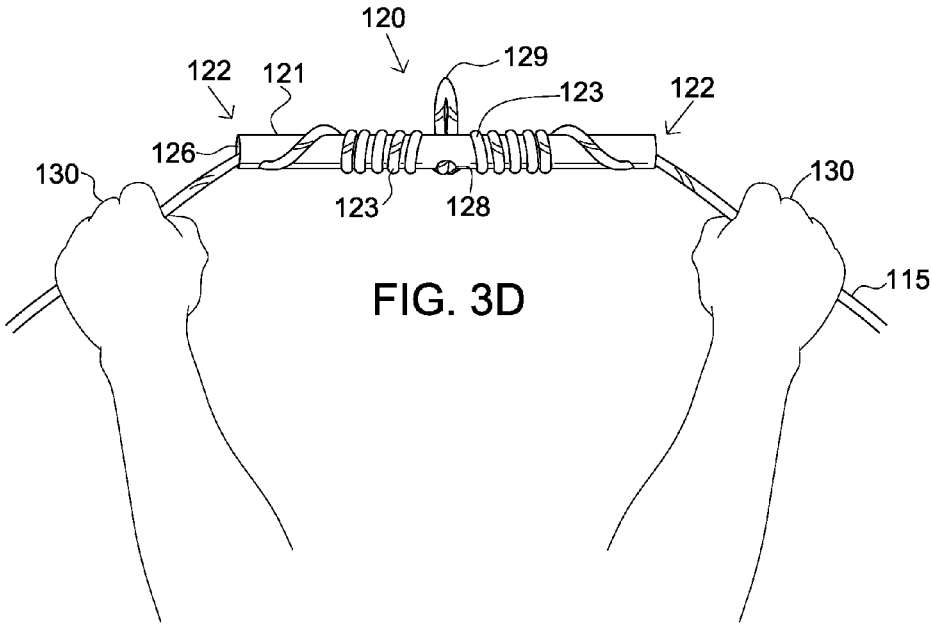

To deploy a pool cover handling device using a flexible pulling device 115, the user typically unwraps the flexible pulling device from the coiling member 121 by removing the medial loop tip 129 from the central aperture 128, and pulling on the flexible pulling device at locations proximate the lateral guides 122 beyond the medial loop 123, examples of locations proximate the lateral guides beyond the medial loop being illustrated by the user's hands 130 in FIG. 3D. By such action, the medial loop typically unwraps from the coiling member and a portion of the flexible pulling device slides through the lateral guides until most of the flexible pulling device resides not between the lateral guides, as best illustrated in FIG. 3A. The core 121 also serves as a handle for the user to grasp when deploying the flexible pool cover.

The user typically uses the propelling apparatus 110 to propel the leading edge 135 of the pool cover 131 across the water surface 140 in a substantially straight line without a portion or corner of the leading edge lagging substantially behind; the pool cover is thus deployed. A portion of the pool cover typically unrolls from the rolled storage device 135 onto the water surface 140 as the pool cover is deployed. Variations of pool covers are stored by means other than rolled storage devices, for subsequent deployment using embodiments of pool cover handling devices. For example, some flexible pool covers are folded rather than being rolled for storage, and are deployed onto a water surface from a folded configuration.

A Second Embodiment Pool Cover Handling Device

Figure 4:
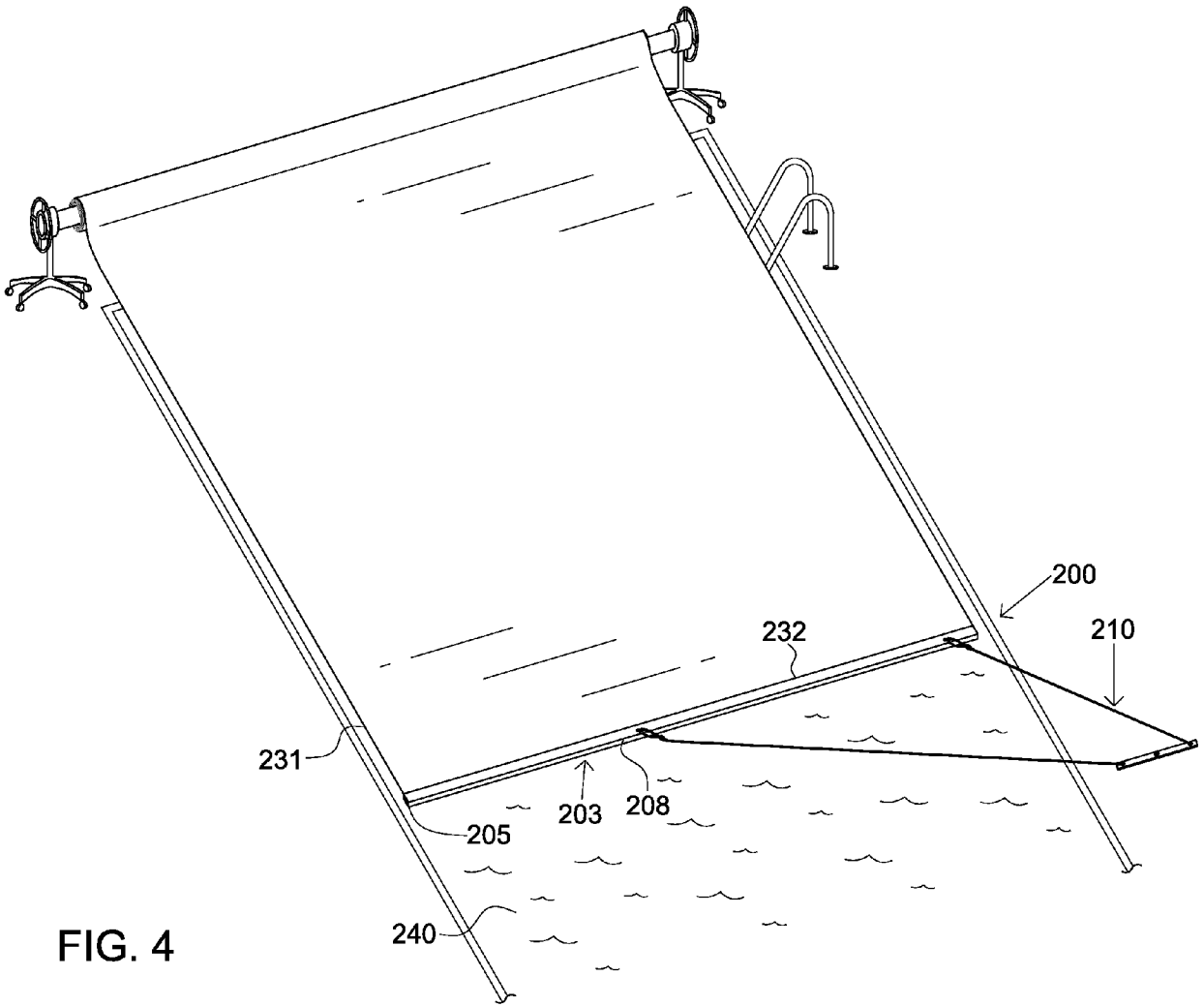
FIG. 4 is an isometric view of a pool cover handling device, according to one embodiment of the present invention.

A second embodiment pool cover handling device 200 is illustrated in FIG. 4. The pool cover handling device comprises a floating beam 203 and a propelling apparatus 210, the floating beam being disposed at a leading edge 232 of a pool cover 231. The floating beam comprises an elongate member 205. The elongate member of the second embodiment comprises polystyrene foam that is highly buoyant, and is therefore also a buoyant member; it therefore requires no additional buoyant member in order to float on the water surface 240. Variations include other buoyant foams such as, but not limited to, open cell and closed cell foams, polyurethane foam, or polyolefin foam. Embodiments of floating beams comprising materials that are susceptible to absorbing water or becoming water logged perform best if covered with a water resistant or water proof cover, such as, but not limited to, urethane or PVC coated nylon.

The second embodiment pool cover handling device 200 further comprises a sleeve in which the elongate member 205 resides, the sleeve (i) being formed from pool cover material, (ii) residing at a leading edge 232 of the pool cover 231, and, (iii) being integral to and continuous with the pool cover. Thus the floating beam of the second embodiment pool cover handling device 200 is integral to and continuous with the pool cover whose handling it facilitates. The sleeve of the second embodiment pool cover handling device can not be distinguished from the elongate member in FIG. 4. Some embodiments of buoyant elongate members, including, but not limited to those made of open cell and closed cell foam, are distinct from pool covers to which they are coupled.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A pool cover handling device comprising:

a floating beam having a water tight density of less than 1.0 gram per cubic centimeter and including an elongate member, the elongate member being substantially rigid and more than 3 feet long;

an attachment assembly, the attachment assembly being adapted to detachably couple the floating beam to a flexible pool cover;

a propelling device for manually deploying the pool cover handling device, the propelling device including:

a one-piece flexible pulling device coupled to the floating beam; and a hand-held coiling member including a core more than 100 mm long with 2 lateral guides residing on the core and separated from each other by at least 100 mm, the flexible pulling device extending uninterrupted from the floating beam, through the lateral guides, and back to the floating beam;

wherein the hand-held coiling member includes a central aperture sized for receiving and securing a portion of a medial loop formed by the flexible pulling device between the 2 lateral guides.

2. The pool cover handling device of claim 1, wherein the floating beam is adapted to float in water with its top surface residing between 5 mm and 20 mm above a surface of the water to prevent water from flowing onto a flexible pool cover during deployment.

3. The pool cover handling device of claim 2, further comprising open or closed cell foam surrounding a portion of the floating beam.

4. The pool cover handling device of claim 3, wherein the flexible pulling device includes a rope and comprises a medial loop residing between the lateral guides.

5. The pool cover handling device of claim 2, wherein the floating beam comprises multiple, separable sections.

6. The pool cover handling device of claim 2, wherein each of the lateral guides comprises an end hole and a side hole, the end hole and side hole residing in the core.

7. A method of using the pool cover handling device of claim 1 comprising:

walking alongside a swimming pool while carrying the coiling member and pulling the floating beam along a surface of water in the swimming pool; and deploying a flexible pool cover onto the surface of the water.

8. The method of claim 7, wherein the a top surface of the floating beam resides at least 20 mm above a surface of the water and obstructs water from flowing onto the pool cover during deployment.

9. The pool cover handling device of claim 1, wherein the floating beam is adapted to float in water with its top surface residing at least 20 mm above a surface of the water to prevent water from flowing onto a flexible pool cover during deployment.

10. The pool cover handling device of claim 1, wherein the flexible pulling device is coupled to the floating beam with a swivel hook.

11. A pool cover combination for deploying a pool cover onto a water surface while preventing water from flowing onto the pool cover, comprising:

a flexible pool cover;

a floating beam coupled to the flexible pool cover, the floating beam being substantially rigid and more than 3 feet long; and a manually operated propelling device including:

a unitary flexible pulling device coupled to the floating beam a hand-held coiling member including a core more than 100 mm long with 2 lateral guides residing on the core and separated from each other by at least 100 mm, the flexible pulling device extending uninterrupted from the floating beam, through the lateral guides, and back to the floating beam, with the flexible pulling device forming a medial loop between the lateral guides;

wherein the hand-held coiling member includes a central aperture sized for receiving and securing a portion of the medial loop.

12. The pool cover combination of claim 11, further comprising water residing in a swimming pool, wherein the floating beam resides in the water with a top surface of the floating beam residing at least 5 mm above a surface of the water.

13. A method of using the pool cover combination of claim 12 comprising:

unwrapping the flexible pulling device from the hand held coiling member;

reducing a size of the medial loop by pulling the flexible pulling device through the lateral guides; and deploying the flexible pool cover by pulling the floating beam across the water while walking beside the pool and carrying the coiling member.

14. The method of claim 13, wherein a top surface of the floating beam resides at least 20 mm above a surface of the water and the floating beam obstructs the water from flowing onto the flexible pool cover during deployment.

15. A method of using a pool cover combination comprising:

providing the pool cover combination, the pool cover combination comprising:

water residing in a swimming pool;

a flexible pool cover;

a floating beam, the floating beam residing in the water and being:

substantially rigid;

at least 3 feet long;

removably coupled to the pool cover;

a manually operated propelling device including:

a rope coupled to the floating beam;

a hand held coiling member including a core more than 100 mm long with 2 lateral guides residing on the core and separated from each other by at least 100 mm, the rope forming a medial loop between the lateral guides and extending uninterrupted from the floating beam, through the lateral guides, and back to the floating beam;

unwrapping the rope from the hand held coiling member;

reducing a size of the medial loop by pulling the rope through the lateral guides; and deploying the flexible pool cover by pulling the floating beam across the water while walking beside the pool and carrying the coiling member.

16. The method of claim 15, wherein the 2 lateral guides each comprise an end hole and a side hole in the core.

17. The method of claim 16, wherein a top surface of the floating beam resides at least 20 mm above a surface of the water to obstruct water from flowing onto the flexible pool cover during deployment.

18. The method of claim 15, further comprising coiling the medial loop about the core of the coiling member.

* * * * *